US007506724B2

(12) United States Patent
Delaloye

(10) Patent No.: US 7,506,724 B2
(45) Date of Patent: Mar. 24, 2009

(54) ACTIVE GAS TURBINE LUBRICATION SYSTEM FLOW CONTROL

(75) Inventor: Jim E. Delaloye, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 719 days.

(21) Appl. No.: 10/897,782

(22) Filed: Jul. 23, 2004

(65) Prior Publication Data

US 2006/0054406 A1 Mar. 16, 2006

(51) Int. Cl.
*F01M 1/00* (2006.01)

(52) U.S. Cl. ..... 184/6.2; 184/6.1; 184/6.4; 137/38

(58) Field of Classification Search ..... 184/6.1, 184/6.2, 6.4; 137/38; 60/36.08
See application file for complete search history.

(56) References Cited

U.S. PATENT DOCUMENTS

| | | | | | |
|---|---|---|---|---|---|
| 1,866,280 | A | * | 7/1932 | Woolson | 184/6.2 |
| 1,997,700 | A | * | 4/1935 | Short | 184/6.4 |
| 2,102,514 | A | * | 12/1937 | Clarkson | 184/6.3 |
| 2,239,098 | A | * | 4/1941 | Hunter | 137/38 |
| 2,245,198 | A | * | 6/1941 | Hunter et al. | 137/38 |
| 2,312,495 | A | * | 3/1943 | Soucek | 137/38 |
| 2,317,745 | A | * | 4/1943 | Duckstein | 123/196 R |
| 2,332,007 | A | * | 10/1943 | Parker | 137/38 |
| 2,379,579 | A | * | 7/1945 | Hunter | 184/6.13 |
| 2,613,498 | A | * | 10/1952 | Prendergast | 60/39.08 |
| 4,049,401 | A | * | 9/1977 | Smith | 55/401 |
| 4,153,141 | A | | 5/1979 | Methlie | |
| 4,445,168 | A | | 4/1984 | Petryszyn | |
| 4,511,016 | A | | 4/1985 | Doell | |
| 4,531,358 | A | | 7/1985 | Smith | |
| 4,632,085 | A | | 12/1986 | Misawa et al. | |
| 5,067,454 | A | | 11/1991 | Waddington et al. | |
| 5,152,141 | A | | 10/1992 | Rumford et al. | |
| 6,082,322 | A | | 7/2000 | Graham et al. | |
| 6,463,819 | B1 | | 10/2002 | Rago | |
| 2001/0047647 | A1 | | 12/2001 | Cornet | |

* cited by examiner

*Primary Examiner*—David M Fenstermacher
(74) *Attorney, Agent, or Firm*—Ingrassia Fisher & Lorenz, P.C.

(57) ABSTRACT

A lubrication system is provided for an aircraft turbine machine, the lubrication system being controlled by a closed-loop logic arrangement, wherein the oil pressure of a lubricant circulated therein is monitored and altered according to attitude data, acceleration data, operating mode data, or some combination thereof contained in a signal received from an airframe flight controller and according to a oil pressure signal and an oil temperature signal. The logic responsively provides a supply pump speed control signal, according to a predetermined target oil pressure value selected to correspond to the data contained in the signals. The target value may be continuously compared to the present oil pressure value and the present oil pressure adjusted by sending a motor control signal to the supply pump and a valve flow control signal to a flow control valve that conditionally allows oil from the outlet side of the supply pump to be fed back to its inlet side.

6 Claims, 3 Drawing Sheets

ACTIVE GAS TURBINE LUBRICATION SYSTEM FLOW CONTROL

BACKGROUND OF THE INVENTION

The present invention generally relates to avionics systems in commercial and military aircraft, and more specifically, to the control of oil cooling and lubrication systems.

Aircraft turbine engines require cooling and lubrication systems to maintain a flow of oil through the engine. Engines in general typically rely on the force of gravity to maintain the lubricating fluid, typically oil, in a reservoir providing oil for pumps moving the oil to wetted components in the machine. If the oil is in a reservoir in which the oil may collect in a known portion of the reservoir, then inlets, valving, and conduits may be reliably placed so as to the maintain the oil flow throughout the engine.

However, aircraft turbine engines, regardless of whether they are involved with propulsive systems or non-propulsive systems such as auxiliary power or environmental cabin systems, cannot rely on the force of gravity in this manner, since they must operate through extreme attitudes in which gravity does not always operate in the same direction with respect to the engine. Furthermore, varying acceleration forces are superimposed upon the force of gravity so that the oil contained in the lubrication system may be subjected to forces coming from any direction. These acceleration forces may cause the lubricating oil to be positioned at any portion of the tank, so that an inlet advantageously located for a gravity fed system may be starved for lubricating oil and thus cause a lower or inadequate oil pressure in the system. This imposes special requirements upon the design and configuration of such lubrication systems in order to maintain continuous and sufficient flow of lubrication to high speed, gas turbine engines typically found in aircraft. Not only must the physical components of the aircraft lubrication systems be designed to accommodate acceleration forces coming from any direction, the components must also be synchronously controlled so that they cooperatively move the lubricating fluid through the system when the system is subjected to varying attitudes or acceleration forces.

These lubricating systems must also be capable of reacting to changes in aircraft operating mode. For propulsive turbine machines, a number of methods have been devised to maintain the flow of lubricating oil to the engine during variable acceleration forces. However, for non-propulsive turbine machines, these methods have been found to be overly complex and thus inappropriate with respect to the less critical nature of non-propulsive turbine machines. For example, if the aircraft is in takeoff mode or combat (surge) mode, high engine speeds are required which necessitate increased lubricating oil flow for cooling the propulsive turbine machine, but the non-propulsive turbine machines do not have such critical cooling and lubrication requirements and can sustain short periods of little or not lubrication without damage. Such cooling requirements may have only a minimal effect on oil pressure for non-propulsive turbine machine, and necessitate the use of additional controls that respond to oil temperature.

Simple volumetric pumps are sometimes used, which are operated by a shaft that is driven by the turbine engine, so that the speed of the pump is directly proportional to the speed of the engine. Thus, the shaft speed at which such pumps operate is not adjustable independently of engine speed and may not be responsive to the actual lubrication needs of the engine.

Finally, turbine machines used for propulsion have different operating parameters than turbine machines used for auxiliary tasks, such as auxiliary power units and environmental systems. These latter non-propulsive turbine machines do not necessarily require continuous, non-interruptible lubrication and can continue to operate for as long as 30 seconds during complete oil deprivation, or longer at reduced oil flow rates, before the oil wetted component is subjected to damaging distress.

The prior art contains numerous examples of how these control problems have been addressed in aircraft engine lubrication systems. U.S. Pat. No. 6,463,819 to Rago discloses a unitary valve that provides an uninterrupted oil supply during different flight attitudes. An oil reservoir is provided having multiple outlet ports to accommodate an oil supply that may be in different parts of the reservoir. A unitary valve senses the oil pressure in a journal enclosure that maintains lubricating oil around a turbine shaft. This change in oil pressure may result from oil starvation at the oil pump when the aircraft changes attitude. The unitary valve reacts hydraulically to the change in oil pressure and directs the input to the oil pump to an alternate outlet port where the lubricating oil might be oriented within the oil reservoir. This arrangement reacts strictly to oil pressure and may not be able to provide sufficient oil in the event oil temperature increases, necessitating an increased flow of lubricating oil to cool turbine engine parts.

U.S. Pat. No. 5,152,141 to Rumford proposes a process for electrically driving and managing the oil pump of a gas turbine engine. Electrical power is supplied to one or more electronic controllers which manage a plurality of electric motors that are typically coupled to oil pumps, among other equipment. According to the U.S. Pat. No. 5,152,141, after starting the main engine, the electronic controller is used to increase the speed of the auxiliary electric motors until they are synchronous with a starter-generator, the rotational speed of which is continuously proportional to that of the turbine engine. Next, the functioning of the auxiliary electric motors continues while maintaining electrical coupling between the starter-generator and each of these motors. In particular, the speed of the oil pump varies between start-up and the maximum speed of the engine along a predetermined acceleration curve. The acceleration communicated to this pump is chosen to allow optimum lubrication of the moving parts of the turbine engine. However the shaft speed of the electric motors is not responsive to the attitude of the aircraft and may not provide the amount of oil necessary for different maneuvers.

U.S. Pat. Appl. Pub. No. US2001/0047647 to Cornet discloses a process for lubricating an aircraft engine. The process employs a variable speed pump that operates independently of the rotational speed of the engine shaft and that is controlled by a control system preferably in the form of a predetermined law in order to adapt to the actual lubrication needs of the engine. The laws may be according to open-loop, closed-loop, or fuzzy logic, each based on one or more engine parameters such as pressure, temperature, shaft speed, and mechanical load. However, Pat. Appl. Pub. US2001/0047647 does not address the issues of using the control logic as a function of inverted flight, airframe maneuvers, or non-gravitational accelerations.

As can be seen, there is a need for a method of controlling a lubrication circuit, where the method is simple, straightforward, and responsive to changing turbine machine needs and to airframe maneuver parameters, so that the lubrication circuit can provide sufficient lubrication regardless of airframe maneuver forces.

SUMMARY OF THE INVENTION

In one aspect of the invention, a lubrication system for a turbine machine is provided, the system comprising a reservoir containing a lubricant; a supply pump with a supply inlet and a supply outlet, the supply inlet in communication with the reservoir for removing lubricant therefrom, and the supply outlet in communication with a bearing sump associated with the turbine machine for providing lubricant thereto; a scavenging pump with a scavenging pump inlet and a scavenging pump outlet, the scavenging pump inlet in communication with the bearing sump for removing lubricant therefrom and the scavenging pump outlet in communication with the reservoir for the return of lubricant thereto; a motor with a shaft configured for actuating the supply pump, and a control circuit for receiving a lubricant pressure value and a maneuver signal, the control circuit responsively providing control of the motor shaft speed.

In still another aspect of the invention, there is provided a control system for a lubrication circuit of a turbine machine in an aircraft, where the lubrication circuit has a supply pump and a scavenging pump jointly operated by a shaft of an electric motor for circulation of a lubricant through the lubrication system, the supply pump being responsive to a motor control signal, and the lubrication circuit providing an pressure signal representing the pressure of the lubricant. The control system may comprise a control device for receiving the pressure signal from the lubrication circuit and a maneuver signal. The control device may provide to the lubrication circuit a motor control signal. A control module may reside in a digital memory of the control device, the control module operatively responsive to both the pressure signal and the maneuver signal in order to provide the motor control signal to vary the speed of the electric motor.

In yet another aspect of the invention, a method for controlling a lubrication circuit for a turbine engine in an airframe is provided, Where the lubrication circuit has a supply pump for providing oil to the turbine machine. The method may comprise receiving a maneuver signal; selecting a target oil pressure value based upon the maneuver signal; receiving from the lubrication circuit a first oil pressure signal containing a present oil pressure value; comparing the target oil pressure value to the present oil pressure value to determine whether or not the present oil pressure value is within an interval of values around the target oil pressure value; and performing a loop while the present oil pressure value is not within the interval. Performing the loop may comprise the steps of determining a motor control signal using the present oil pressure value; sending the motor control signal to the supply pump to change a present motor speed; receiving from the lubrication circuit a second oil pressure signal containing the present oil pressure value; and comparing the target oil pressure value to the present oil pressure value to determine whether or not the present oil pressure value is within an interval of values around the target oil pressure value.

In still a further aspect of the invention, a computer program product is provided for use on a control device for controlling a lubrication circuit that supplies lubricant to a turbine machine on an aircraft, where the lubrication circuit has a supply pump operated by an electric motor. The computer program product may comprise a computer usable medium having computer readable program code means embodied therein for causing the electric motor to vary its shaft speed. The computer program product may further contain first computer readable program code means for receiving a pressure signal containing a pressure value for the lubricant in the lubrication circuit and a maneuver signal describing aircraft maneuver characteristics; second computer readable program code means for developing a motor control signal that is calculated from the pressure value and the maneuver characteristics; and third computer readable program code means for causing the control device to send a motor control signal to the electric motor.

In yet a further aspect of the invention, a program storage device readable by a control device is provided, where the program storage device tangibly embodies a program of instructions executable by the control device to perform method steps directed to the control of a lubrication circuit that provides lubricant to a turbine machine on an aircraft, wherein the lubrication circuit comprises a supply pump operated by an electric motor. The method steps referenced above may comprise receiving a maneuver signal containing data indicative an aircraft maneuver characteristics; selecting a target lubricant pressure value based upon the maneuver characteristics data; receiving from the lubrication circuit a first pressure signal containing a present pressure value for the lubricant in the lubrication circuit; comparing the target pressure value with the present pressure value to determine whether or not the present pressure value is within an interval of values around the target pressure value; and performing a loop while the present pressure value is not within the interval. The loop may contain the further steps of determining a motor control signal using the present pressure value; sending the motor control signal to the electric motor to change a present motor speed, thereby changing the volume of lubricant pumped by the supply pump; receiving from the lubrication circuit a second pressure signal containing the present pressure value; and comparing the target pressure value to the present pressure value to determine whether or not the present pressure value is within the interval of values around the target pressure value.

These and other features, aspects and advantages of the present invention will become better understood with reference to the following drawings, description, and claims.

DETAILED DESCRIPTION OF THE INVENTION

Figure 1:
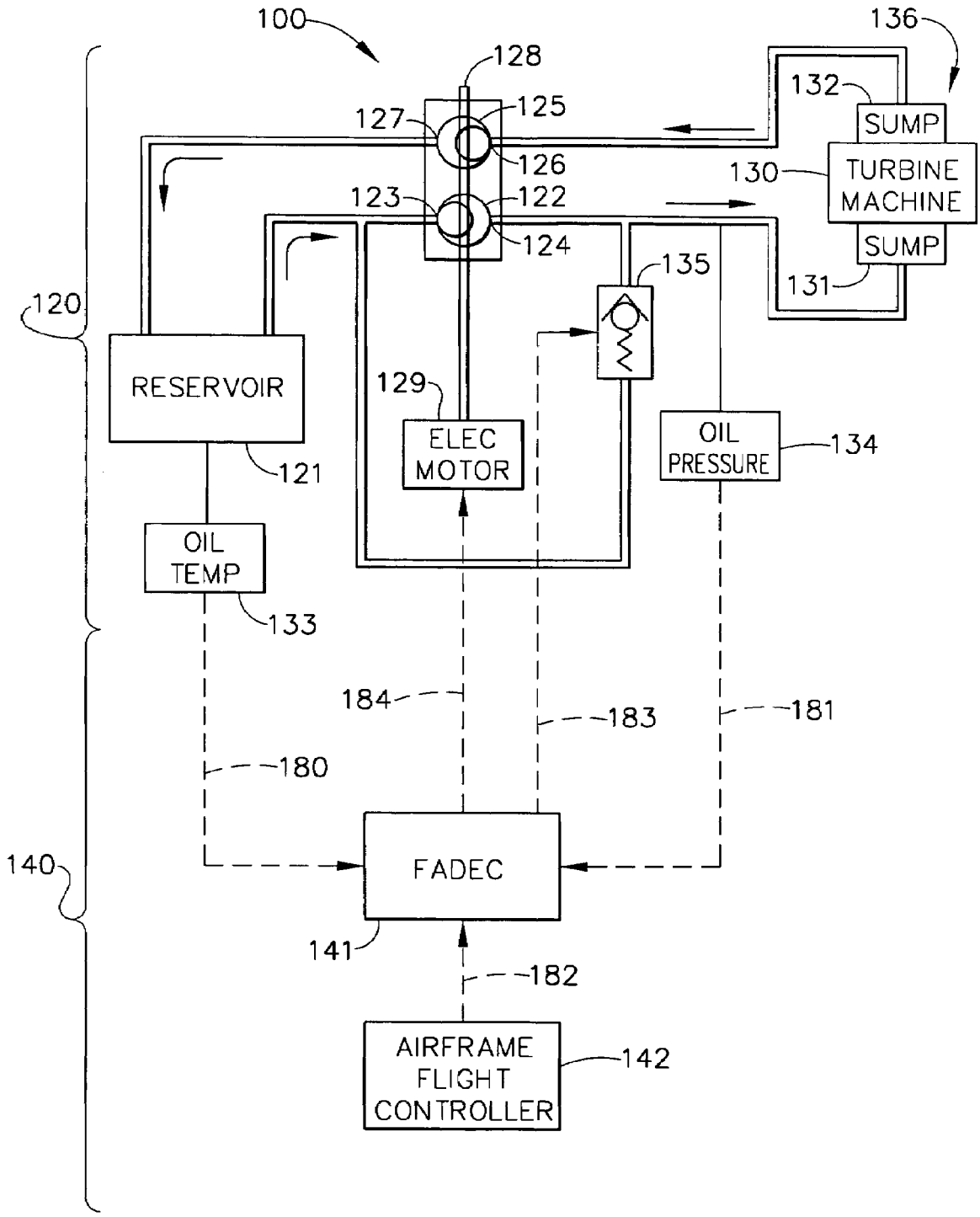
FIG. 1 is a schematic diagram of an aircraft engine lubrication system, according to an embodiment of the invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides a system and method for lubricating a turbine machine used on, for example, an aircraft that may undergo maneuvers that encompass normal gravitation, negative gravitation, and zero gravitation conditions. More specifically, military fighter aircraft, such as the joint strike fighter (JSF), may include non-propulsive turbine machines for purposes of auxiliary power and environmental systems operation. These aircraft may undergo often violent and extreme changes in attitude where positive, zero, and negative gravitational accelerative forces are imposed upon the aircraft systems.

The present invention provides a lubrication system that provides lubricating oil to a non-propulsive turbine machine through use of an oil pump that does not depend upon the rotational speed of the shaft of the main propulsion turbine machine. The oil pumps of the lubrication system of the present invention may be driven by an electric motor, which may provide the ability to control pump shaft speed independently of the shaft speed of the turbo machine. Control of pump shaft speed may be responsive to values describing the aircraft maneuver characteristics. More specifically, such maneuver characteristics may include indicators of the present aircraft attitude; the magnitude and direction of the acceleration vector for the aircraft; the current operating mode of the aircraft; or some combination of these indicators. In addition, a discrete electromechanical flow control valve may provide another regulation capability for regulating lubrication/cooling oil flow as a function of these aircraft maneuver characteristics. A closed-cycle control circuit may be provided to monitor the oil pressure and aircraft maneuver characteristics and to provide control signals to maintain and change the shaft speed of the electric motor and to either close or open the discrete electromechanical flow control valve. The control circuit may be electrical and not mechanical in nature, the circuit being controlled by a digital computing device.

Prior art systems are generally strictly mechanical, where oil pressure hydraulically controls valve and pump settings. Furthermore, the shaft speed of such prior art oil pumps has heretofore been kinematically coupled with the shaft speed of the turbine machine. Newer prior art systems have proposed the provision of individual electric motors for each oil pump in the lubrication system, resulting in additional components that may be more prone, as a system, to failure. Closed loop digital control systems have also been proposed, but none have included provision for consideration of either aircraft maneuver characteristics as a controlling element or the closed loop pressure control schedules proposed herein. The instant invention provides a system and a process that overcome these deficiencies by variably controlling the flow of oil that is dependent upon the oil pressure and aircraft maneuver characteristics; such a method and system is inherently more reliable and less complex than prior art systems.

Referring now to FIG. 1, a simplified schematic diagram of lubrication system 100 is shown according to an embodiment of the invention. A lubrication circuit 120 may circulate a lubricant, typically oil, throughout the lubrication system 100, while a control circuit 140 may control the amount of lubricant that is circulated. A number of components, e.g., oil heat exchanger, various valves, the venting system, details of the turbine machine, and duplicate pump units, have been omitted from the simplified schematic diagram to better illustrate the principles of the invention. It should be understood by those skilled in the art that a lubrication system for an airborne turbine machine may include more components than are shown in FIG. 1.

The lubrication circuit 120 may include a reservoir 121 holding a quantity of lubricant for use within the lubrication circuit 120. The lubricant typically used by such systems may be oil, but other lubricants may be used without departing from the scope of the invention. It should be understood that the term "oil" may be used interchangeably within this description for either a general lubricant or the specific lubricant oil, since the composition of the lubricant is not material to the invention. A supply pump 122 may remove oil from the reservoir 121 through a conduit to its inlet 123 and provide the oil under pressure from its outlet 124 to the inlet side 131 of bearing sump 136 of a turbine machine 130. Similarly, a scavenging pump 125 may remove oil from the outlet side 132 of bearing sump 136 through a conduit connected to its inlet 126 and return the oil to the reservoir 121 through a conduit from its outlet 127. The supply pump 122 and scavenging pump 125 may both be actuated by a common shaft 128, which in turn may be driven by a single drive motor 129.

It should be understood that the description providing for a single supply pump 122 and a single scavenging pump 125 may be illustrative of the general concept of a lubrication system 100, and multiple pumps may also be included within the lubrication system 100 without departing from the scope of the invention. Furthermore, each pump, whether supplying lubricant or returning lubricant, may be driven by a separate shaft and motor without departing from the scope of the invention. The configuration shown may have the advantage of simplicity, in that a single shaft 128 and motor 129 may drive multiple pumps; however, the use of multiple motors (and shafts) may support requirements for redundancy as needed. A 3-phase, brushless DC electric motor may provide the necessary actuating function to drive the scavenging pump 125 and supply pump 122, where both may be actuated by a single, common shaft 128. Such an electric motor 129 may provide the ability to control the pump shaft speed independently of turbo machine speed. The electric drive motor may be of various electric machine configurations that permit external control of pump shaft speed without departing from the scope of the invention. Each pump 122, 125 may typically be a volumetric or volume displacement type of pump, such as georotor pumps typically used in the art, which may have the capability to pump air mixed with oil; these fixed capacity pumps have a fixed capacity and are simple, reliable, and light. The pump may also be of other displacement types without departing from the scope of the invention.

A discrete electromechanical flow control valve 135 may be connected to the outlet 124 side of the supply pump 122 to provide a feedback path for oil pressurized by the supply pump 122 to be selectively returned to the inlet 123 side of the supply pump 122. The flow control valve 135 may provide an on-state and an off-state. The on-state may permit a portion of the lubricating oil to flow back to the inlet 123 side of the supply pump 122 while the airframe is subjected to specified airframe maneuver forces, thereby, reducing the amount of oil flow to the turbine machine while maintaining adequate scavenge pump speed. The off-state may prevent the lubricating oil from flowing back to the inlet 123. This feedback path may provide the ability to regulate lubrication flow as a function of selected aircraft maneuver characteristics in a manner described hereinbelow.

The lubrication circuit 120 may include sensors to provide values for oil temperature and oil pressure in the form of informational signals. Specifically, the lubrication circuit 120 may have an oil temperature sensor 133 for providing temperature readings of the oil in the reservoir 121. The lubrication circuit 120 may also have an oil pressure sensor 134 for providing oil pressure readings. The oil pressure readings may be taken at the outlet 124 side of the supply pump 122 between the supply pump 122 and the inlet side 131 of bearing sump 136. The oil temperature and oil pressure sensors 133, 134 may be electromechanical in construction, and may provide either an analog or digital signal without departing from the scope of the invention.

The control circuit 140 may provide closed-loop control of the operation of the lubrication system 100. A full authority digital engine control, or FADEC, 141 may be provided to receive informational signals from the lubrication circuit 120 and turbine machine, and other systems within the airframe, and to provide control signals to elements of the lubrication circuit 120. The FADEC 141 may be configured as any standard control device known to the industry and may comprise a computer or cooperative assembly of computers, assemblies of discrete electronic circuitry, hydraulic devices, and combinations of these items. Although the term "full authority digital engine control" may imply that the device may be used only for propulsive turbine machines, in practice the term may be used as a convenience to mean any control device involved in the control and direction of a turbine machine and its associated subsystems. The FADEC 141 may receive from the lubrication circuit 120 an oil temperature signal 180 from the oil temperature sensor 133 and an oil pressure signal 181 from the oil pressure sensor 134. The FADEC 141 may also receive information pertaining to the current aircraft maneuver characteristics from an airframe flight controller 142 in the form of a maneuver signal 182 from an airframe flight controller 142.

The maneuver signal 182 may contain maneuver information relating to the current operational state of the aircraft such as, but not limited to, the aircraft attitude, the acceleration vector giving the magnitude and direction of acceleration forces acting on the aircraft, the flight mode of the aircraft, or any combination of these data. The flight mode of the aircraft may be considered in general to be an indication of a set of data parameters that may be applied when the aircraft is operating in a particular circumstance or environment, such as combat mode, landing mode, takeoff mode, emergency mode, and ground maintenance mode, by way of example and not limitation. When received from another airframe computing element such as an airframe flight controller 142, the maneuver signal 182 may be in the form of a message on a communications bus interconnecting the airframe flight controller 142 and the FADEC 141, such as a MIL-STD-1553 bus or an ARINC 429 bus, by way of examples. The FADEC 141 in turn may provide a motor control signal 184 to the motor 129 for direct speed control of the shaft speed of the motor 129 and also a valve control signal 183 to the flow control valve 135 for on/off control of the flow control valve 135. In a particular embodiment, the maneuver signal 182 may contain the flight mode of the aircraft in combination with either the acceleration vector or the attitude data.

A closed-loop control process may be implemented within the FADEC 141 by software, read-only memory, programmable logic arrays, discrete electrical components, and the like, which may receive the sensor signals 180, 181 from the lubrication circuit 120 and maneuver signal 182 from the airframe flight controller 142 and based upon turbine machine operational state conditions may in response provide control signals 183, 184 to the lubrication circuit 120, according to control laws that will presently be described. The control laws formulated according to the invention may provide a motor control signal 184 in conjunction with a valve control signal 183 for the control/actuation of the discrete electromechanical flow control valve 135, which together provide the ability to regulate lubrication/cooling flow as a function of turbine machine operational state, airframe attitude, acceleration magnitude and direction, or any combination of these data, as received in the maneuver signal 182. This may allow the cooling/lubricating flow requirements for the turbo machine mechanical systems to be maintained throughout extreme airframe attitude operating envelope.

Prior art control systems maintained shaft speed as a function of altitude. In other words, the shaft speed of the supply pump at sea level would be a given value, but as the altitude increased to 50,000 feet, for example, the same amount of cooling flow would require a higher shaft speed. Prior art requires design and sizing for altitude operation and flow control systems or accept and allow excess flow during regions of the airframe envelope. These prior systems are excessively complex and costly. However the basic concept of a proposed closed-loop control system according to the invention is that flow rate of the oil for a fixed temperature may be maintained as a constant that is a function of oil pressure and is in fact directly proportional to the oil pressure. Thus, for a given required cooling rate, a specified oil pressure may be maintained by controlling the shaft 128 speed of the pump motor 129 and the effect of altitude may be accounted for. Furthermore, the cooling rate may be obtained from a table of specified cooling rates for various combinations of turbine machine operating modes and airframe attitudes or acceleration magnitude and direction forces.

Figure 2:
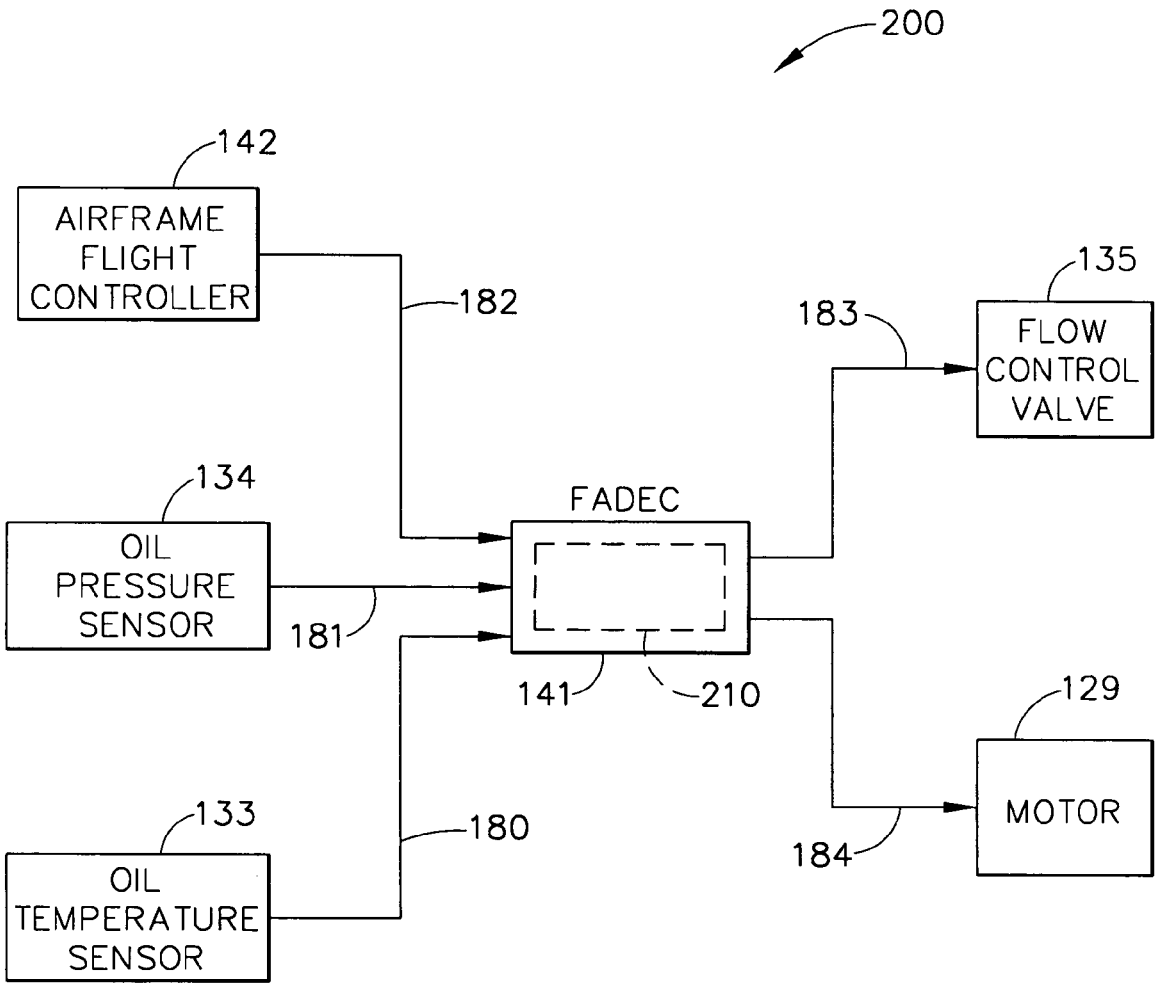
FIG. 2 is a schematic diagram of a control circuit for controlling a lubrication system, according to an embodiment of the invention.

Referring to FIG. 2, an embodiment of a control circuit 200 is shown in more detail. A FADEC 141 may contain a control module 210 to implement control logic that may govern the control of the flow control valve 135 and the electric motor 129. The control module 210 may be implemented within the FADEC 141 by means of an executable software code that is separate from other software codes that may be operable on the FADEC 141, or by means of discrete electrical components. The control module 210 may receive input signals, namely, oil temperature, oil pressure, maneuver signals 180, 181, 182 and may provide motor control and valve control signals 183, 184 to portions of the lubrication circuit 120 (see FIG. 1). The logic may be considered as closed-loop control logic since control of the motor 129 and flow control valve 135 may directly affect the readings obtained from the oil pressure sensor 134 and the oil temperature sensor 133. Because turbine engines may operate at different altitudes, a closed-loop control process based upon oil pressure may considerably simplify the cooling process for the turbine machine. If the airframe flight controller 142 indicates through the maneuver signal 182 that combat mode, for example, is being entered, then this may mean a high shaft speed to maintain the necessary cooling/lubrication requirements.

Figure 3:
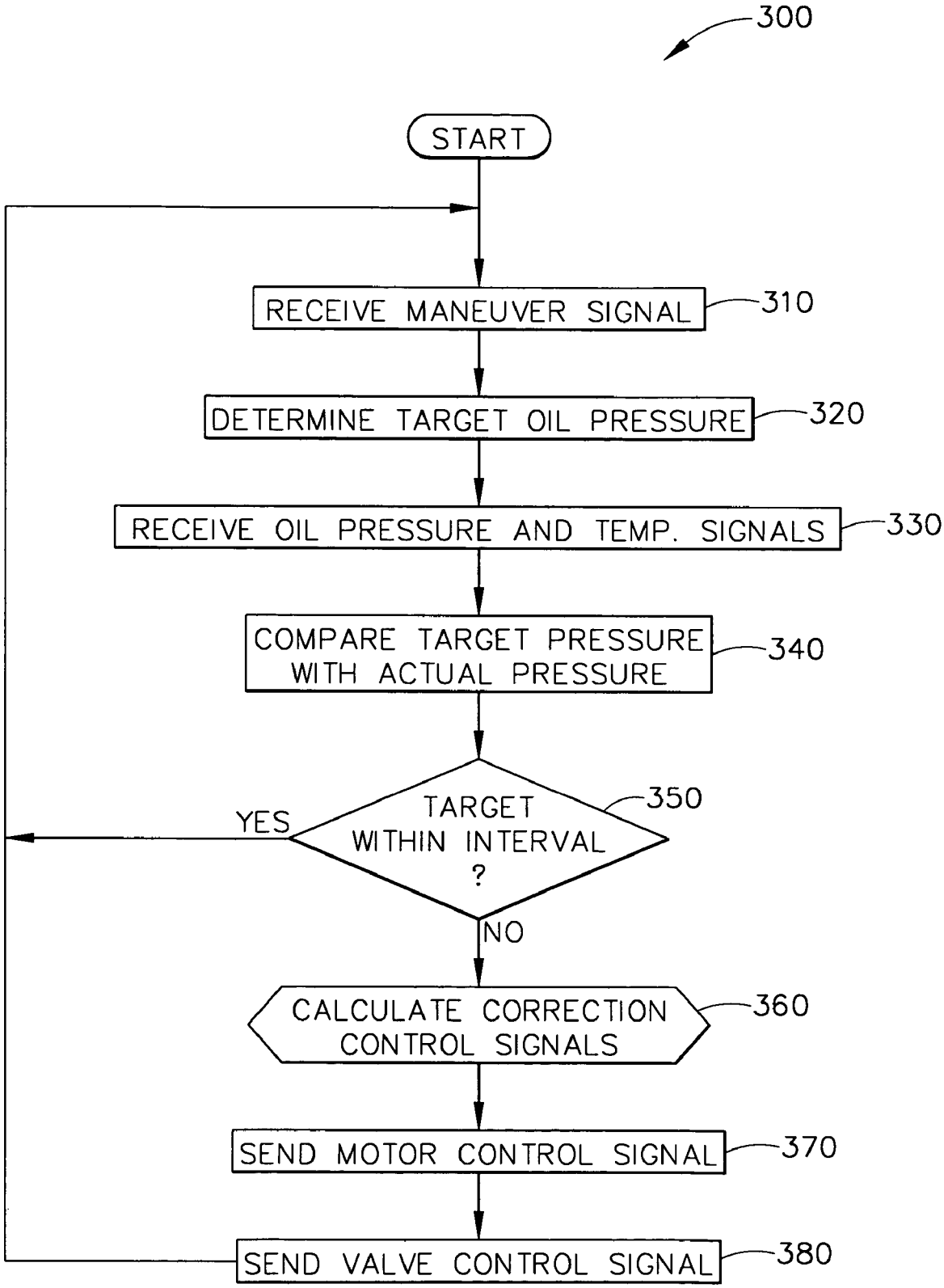
FIG. 3 is a flow diagram of a method of controlling oil pressure by controlling the shaft speed of an electric motor driving a supply pump, according to an embodiment of the invention.

Referring now to FIG. 3, a flowchart is given that illustrates a representative control law according to the invention. According to the block labeled 310, the control module 210 (FIG. 2) may receive a maneuver signal 182 indicating optionally an aircraft attitude at which the aircraft containing the FADEC 141 is being flown, the current acceleration vector representing forces exerted upon the aircraft, the turbine machine operational state or flight mode, or some combination of the three sets of data. Such a maneuver signal 182 may contain an acceleration vector having six components corresponding to six degrees of freedom of the aircraft, a discrete value indicating a mode in which the aircraft is operating (such as, by way of example, combat mode, landing mode, takeoff mode, emergency mode, and ground maintenance mode), an acceleration vector and a mode value, or some other combination of data. The control module 210 (FIG. 2) may also optionally receive an operation state signal (not shown) from the turbine machine sense systems indicating turbine machine speeds and aerodynamic and mechanical loading.

Using the data contained in the maneuver signal 182, the control module 210 (FIG. 2) may determine a target oil pressure value, according to the block labeled 320, for comparison purposes against a continuous reading of the present oil pressure. The control module 210 (FIG. 2) may then receive an oil pressure signal 181 containing a present oil pressure value and an oil temperature signal 180 containing a present oil temperature value, both received from the lubrication circuit 120, according to the block labeled 330.

The target oil pressure may then be compared with the present oil pressure value obtained from the oil pressure signal 181, according to the block labeled 340. The comparison may be made to determine whether or not the oil pressure value obtained from the oil pressure signal 181 is within a small interval around the target oil pressure value, according to the block labeled 340. This small interval may be typically used in control logic circuits to prevent unwanted oscillation about a target value. If, according to the block labeled 350, the present oil pressure value is within the error interval of the target oil pressure value, then no correction control signal may be generated, in which case the flow of control returns to block 310. However, if the present oil pressure value is not within the error interval of the target oil pressure value, then the control module 210 (FIG. 2) may perform a series of actions within an inner control loop. According to block labeled 360, a calculation may be made to determine a correction signal. The correction signal may be sent to the electric motor 129 in the form of a motor control signal 184 and to the discrete flow control valve 135 in the form of a valve control signal 183.

A motor control signal 184 may be sent, according to the block labeled 370, to an electric motor 129 driving the supply pump 122 in the lubrication circuit 120 to change the present speed of the electric motor 129. The magnitude of the motor control signal 184 may be derived according to an appropriate function that may be determined based upon standard engineering design principles well known in the art in block 360. At the same time, according to the block labeled 380, a valve control signal 183 may optionally be sent to the discrete flow control valve 135 in the lubrication circuit 120, depending upon the aircraft maneuver characteristics, the magnitude of the oil pressure, and the magnitude of the oil temperature. From block 380, the flow of control may then return to block 310.

As will be appreciated by one of skill in the art, embodiments of the present invention may be provided as methods, systems, or computer program products. Accordingly, the present invention may take the form of an entirely hardware embodiment, an entirely software embodiment or an embodiment combining software and hardware aspects. Furthermore, the present invention may take the form of a computer program product which is embodied on one or more computer-usable storage media (including, but not limited to, disk storage, CD-ROM, optical storage, programmable read-only memory, and other storage media known in the art) having computer-usable program code embodied therein.

The present invention has also been described with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, embedded processor or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or block diagram block or blocks.

Thus, an inventive control circuit may be provided by the invention, where the control circuit may be a closed-loop type of control circuit relying upon changes in oil pressure of a lubricating system to adjust the oil pressure towards a target value by varying the speed of a supply pump.

It should be understood, of course, that the foregoing relates to exemplary embodiments of the invention and that modifications may be made without departing from the spirit and scope of the invention as set forth in the following claims.

I claim:

1. A control system for a lubrication circuit of a turbine machine, the lubrication circuit having a supply pump and a scavenging pump jointly operated by a shaft of an electric motor for circulation of a lubricant through the lubrication circuit, the supply pump responsive to a motor control signal, the lubrication circuit providing an pressure signal representing the pressure of the lubricant, the control system comprising:

a control device receiving the pressure signal from the lubrication circuit, the control device also receiving a maneuver signal, the control device providing to the lubrication circuit a motor control signal; and a control module residing in a digital memory of the control device, the control module operatively responsive to both the pressure signal and the maneuver signal in order to provide the motor control signal to vary the speed of the electric motor.

2. The control system described in claim 1, wherein:

the lubrication circuit additionally comprises a flow control valve responsive to a valve control signal for selectively controlling a flow of lubricant through a feedback path between an outlet side of the supply pump to an inlet side of the supply pump; and the control module further providing the valve control signal that is also responsive to the pressure signal and the attitude signal.

3. The control system described in claim 1, wherein:

the lubrication circuit additionally provides a temperature signal representing the temperature of the lubricant; and the control module operatively responsive to the pressure signal, the temperature signal, and the maneuver signal in order to provide the motor control signal to vary the speed of the electric motor.

4. The control system described in claim 3, wherein:

the lubrication circuit additionally comprises a flow control valve responsive to a valve control signal for selectively controlling a flow of lubricant through a feedback path between an outlet side of the supply pump to an inlet side of the supply pump; and the control module further providing the valve control signal that is also responsive to the pressure signal, the temperature signal, and the maneuver signal.

5. The control system described in claim 1, wherein the lubricant is oil.

6. The control system described in claim 1, wherein the maneuver signal contains data selected from the group consisting of attitude data and acceleration data.

* * * * *